US006340811B1

(12) United States Patent
Tonomura

(10) Patent No.: US 6,340,811 B1
(45) Date of Patent: Jan. 22, 2002

(54) INDUCTION-HEATED ROLLER DEVICE

(75) Inventor: Toru Tonomura, Kyoto (JP)

(73) Assignee: Tokuden Co., Ltd., Kyoto (JP)

( * ) Notice: Subject to any disclaimer, the term of this patent is extended or adjusted under 35 U.S.C. 154(b) by 0 days.

(21) Appl. No.: 09/884,915

(22) Filed: Jun. 21, 2001

(30) Foreign Application Priority Data

Jul. 6, 2000 (JP) ..... 12-204614
Oct. 20, 2000 (JP) ..... 12-320317

(51) Int. Cl.[7] ..... H05B 6/14; H05B 6/36
(52) U.S. Cl. ..... 219/619; 219/672; 219/669
(58) Field of Search ..... 219/619, 635, 219/647, 652, 660, 662, 669, 670, 672, 674, 676; 100/92; 492/46

(56) References Cited

U.S. PATENT DOCUMENTS 5,895,598 A * 4/1999 Kitano et al. ..... 219/619

FOREIGN PATENT DOCUMENTS

JP 1-265486 * 10/1989 ..... 219/676
JP 6-267651 * 9/1994 ..... 219/619
JP 9-7754 * 1/1997

* cited by examiner

*Primary Examiner*—Philip H. Leung
(74) *Attorney, Agent, or Firm*—Morgan, Lewis & Bockius LLP

(57) ABSTRACT

Twelve induction coils axially arrayed on a roller are arranged into: a first group of induction coils delta connected induction coils excited by a three-phase voltage; a second group of star-connected induction coils being successively disposed while being spaced apart in the phase rotation direction of the first group of induction coils; a third group of delta-connected induction coils being excited by a phase-shifted voltage formed by phase-shifting a three-phase voltage by 180° and being successively disposed while being spaced apart in the phase rotation direction of the second group of induction coils; and a fourth group of star-connected induction coils being excited by a phase-shifted voltage and being successively disposed while being spaced apart in the phase rotation direction of the third group of induction coils.

3 Claims, 23 Drawing Sheets

INDUCTION-HEATED ROLLER DEVICE

BACKGROUND OF THE INVENTION

1. Field of the Invention

The present invention relates to an induction-heated roller device.

2. Description of the Related Art

As well known, the induction-heated roller device is provided with an induction heating mechanism disposed within a rotary roll. The induction heating mechanism includes an iron core and induction coils wound on the iron core. The induction-heated roller device will be described with reference to FIG. 5. In the figure, reference numeral 1 is a roll, and the roll is rotatably supported on a frame 2 by means of a bearing 3, and driven to rotate by a drive source (not shown). Reference numeral 4 is a jacket chamber which is formed in a thick part of the roll 1 and is filled with a two-phase (gas and liquid) heating medium.

An induction heating mechanism 7, located within the hollow space of the roll 1, includes a plurality of induction coils 5 and an iron core 6 wound with the induction coils. Reference numeral 8 indicates magnetic discs each interposed between the adjacent induction coils, and reference numeral 9 indicates a support rod for supporting the induction heating mechanism 7. The support rods 9 are respectively supported within journals 11 coupled to the roll 1 through bearings 10. Reference numeral 12 represents lead wires 12 of the induction coils 5, and those wires are led out to exterior through the support rod 9, and is connected to an AC power source located outside.

A three-phase power source is used for exciting the induction coils. The reason for this is that such a power source is readily available. As well known, a phase difference among the U-, V- and W-phase voltages of the three-phase power source is 120°. Accordingly, three induction coils are used. When the phase voltages are applied to those induction coils, two roll surface areas which are located between the adjacent induction coils while facing the latter, as known, is lower in temperature than the remaining roll surface.

The temperature may be decreased by reducing the phase difference between the voltages applied to the adjacent induction coils. An approach to realize this is proposed in which a three-phase voltage is used as a primary voltage, a multiphase transformer more than four phases is used, and the secondary voltages are applied to more than four induction coils (Japanese Patent Unexamined Publication No. Hei. 9-7754).

In this approach, a phase difference between the voltages applied to the adjacent induction coils may be reduced to be smaller than 120°. Therefore, the local temperature decrease on the roll surface may be lessened when comparing with the case where the three-phase voltage is directly applied to the induction coils. However, this approach indispensably uses the multiphase transformer. Accordingly, the cost to manufacture is increased, and a space to install the multiphase transformer is secured.

SUMMARY OF THE INVENTION

Accordingly, an object of the present invention is to provide an induction-heated roller device which when a power source is a three-phase power source, and voltages whose phases are different from each other by 30° are applied, as exciting voltages, to adjacent induction coils of twelve induction coils disposed within a hollows space of the roll, the exciting voltages having phase differences of 30° may be applied to the induction coils by using only the connection of the induction coils, without the multiphase transformer.

According to the present invention, there is provided an induction-heated roller device having a rotary roll, twelve induction coils for an induction heating mechanism being successively disposed within a hollow space of the roll while being spaced apart in an axial direction of the roll within a hollow space of the roll, a three-phase power source for exciting the induction coils. The induction-heated roller device is improved such that the induction coils being arranged into: a first group of three delta connected induction coils excited by line voltages of the three-phase power source; a second group of three star-connected induction coils being excited by the line voltages and being spaced apart in a phase rotation direction of the first group of induction coils; a third group of three delta-connected induction coils being excited by phase-shifted voltages formed by phase-shifting voltages of the three-phase power source by 180° and being spaced apart in a phase rotation direction of the second group of induction coils; and a fourth group of three star-connected induction coils being excited by the phase-shifted voltages and being spaced apart in a phase rotation direction of the third group of induction coils. The induction-heated roller device may further comprises an x number of induction coils (x: an integer of 1 or greater) connected in parallel with any of 1 to 12 of the twelve induction coils. The induction-heated roller device may also be constructed such that any of 5 to 11 induction coils are selectively located at the positions at which the twelve number of induction coils are to be located and are connected so that a phase difference of the voltages applied to the induction coils is 30°.

The voltages are sequentially applied to the induction coils at a phase interval of 30°. This voltage application is equivalent to the application of the secondary voltages of the multiphase transformer. It is realized by using only the connection of the induction coils, and hence in this respect, there is no need of the multiphase transformer.

DETAILED DESCRIPTION OF THE INVENTION

The preferred embodiments of the present invention will be described with reference to the accompanying drawings.

Figure 5:
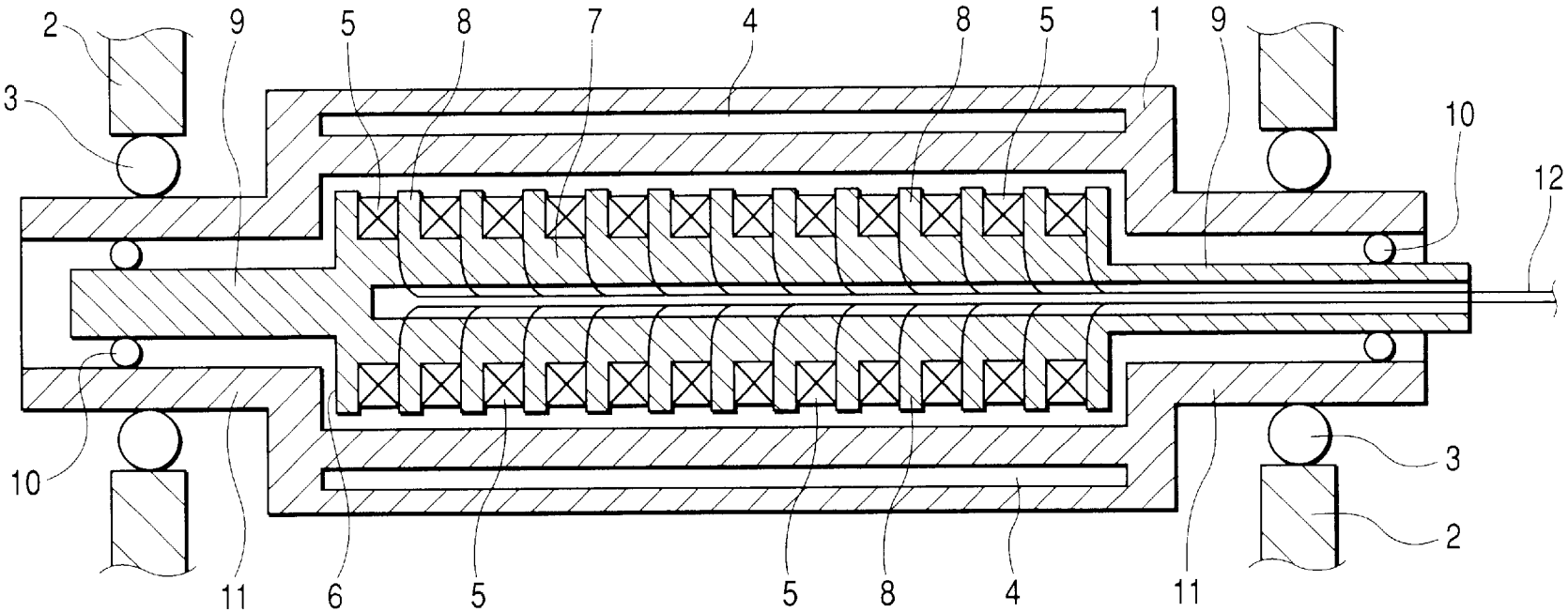
FIG. 5 is a cross sectional view showing an induction-heated roller device used in the FIG. 1.

Twelve induction coils 5 constructed as shown in FIG. 5 are prepared and arranged into four groups each consisting of three induction coils. Three induction coils m, d, h of the first group are delta connected among U-, V- and W-phases of a three-phase power source. Three induction coils a, e, i of the second group are star connected among U-, V- and W-phases of the three-phase power source. Three induction coils b, f, j of the third group are delta connected among phases of three-phase voltages respectively phase-shifted 180° from the corresponding ones of the U-, V- and W-phases of the three-phase power source. Three induction coils c, g, k of the fourth group are star connected among phases of three-phase voltages respectively phase-shifted 180° from the corresponding ones of the U-, V- and W-phases of the three-phase power source.

Figure 3:
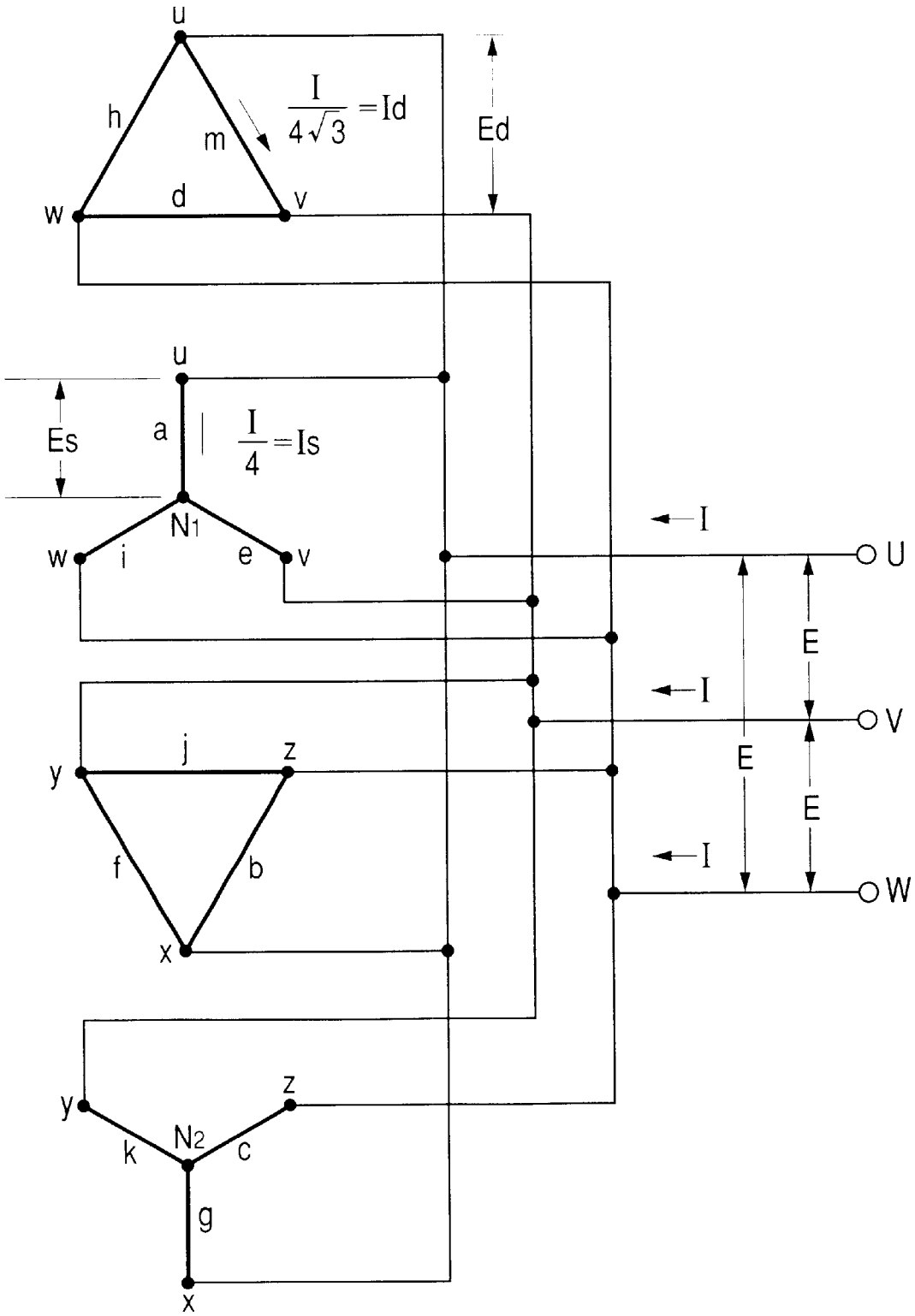
FIG. 3 is a wiring diagram showing the wiring of FIG. 1 in a separated form.

Turning to FIG. 3, the taps of U-, V- and W-phases of the three-phase power source are denoted as u, v and w. As shown, the induction coils of the first group are delta connected among those taps u, v and w, and the induction coils of the second group are star connected among those taps. The taps of the three-phase power source which receive phase voltages respectively phase-shifted 180° from the corresponding ones of the U-, V- and W-phases of the three-phase power source, are denoted as x, y and z. The induction coils of the third group are delta connected among the taps x, y and z, and the induction coils of the fourth group are star connected among those taps. In the figure, N1 and N2 are neutral points in the star connections.

Figure 2:
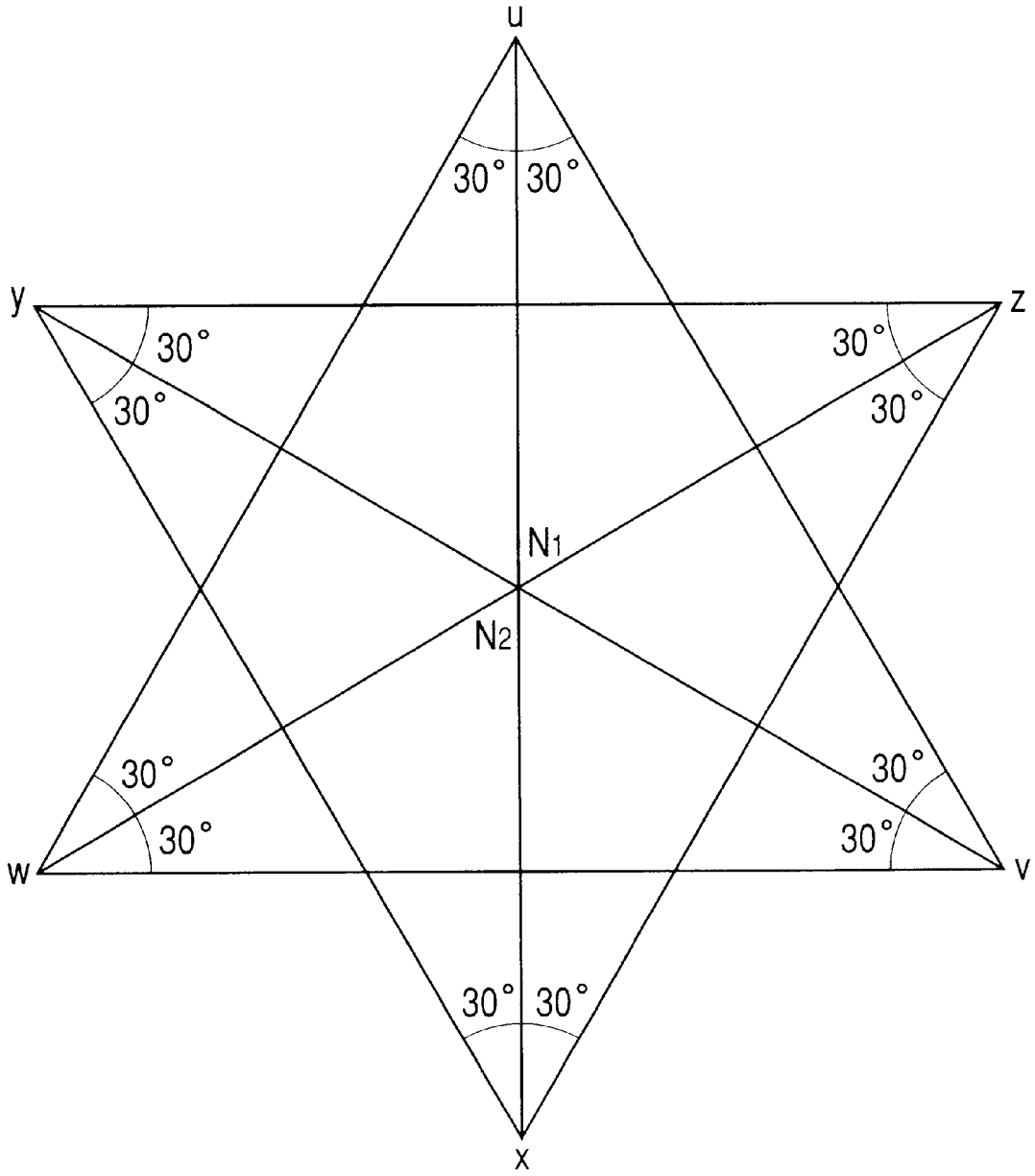
FIG. 2 is a diagram showing phase difference relationships of the voltages applied to the induction coils in FIG. 1.

In the connection of the induction coils, a phase difference among the voltages applied to the induction coils of the first and second groups is 120°. In the first and second groups, the induction coils are respectively connected to the same tap u, the same tap v and the same tap w. Accordingly, a phase difference between the voltages applied to the induction coils m and a is 30°. For the same reason, a phase difference between the voltages applied to other induction coils of those groups respectively connected to the same trap is also 30°. The same thing is true for the remaining induction coils of the third and fourth groups. Phase difference relationships of the voltages applied to the induction coils may be charted as shown in FIG. 2.

The induction coils of the first to fourth groups, thus constructed, are axially disposed side by side within the roll 1. To dispose those induction coils, the induction coils m, d, h of the first group are axially disposed side by side. Subsequently, the induction coils a, e, i of the second group are successively disposed adjacent to the induction coils m, d, h of the first group as viewed in the phase rotation direction.

Figure 4:
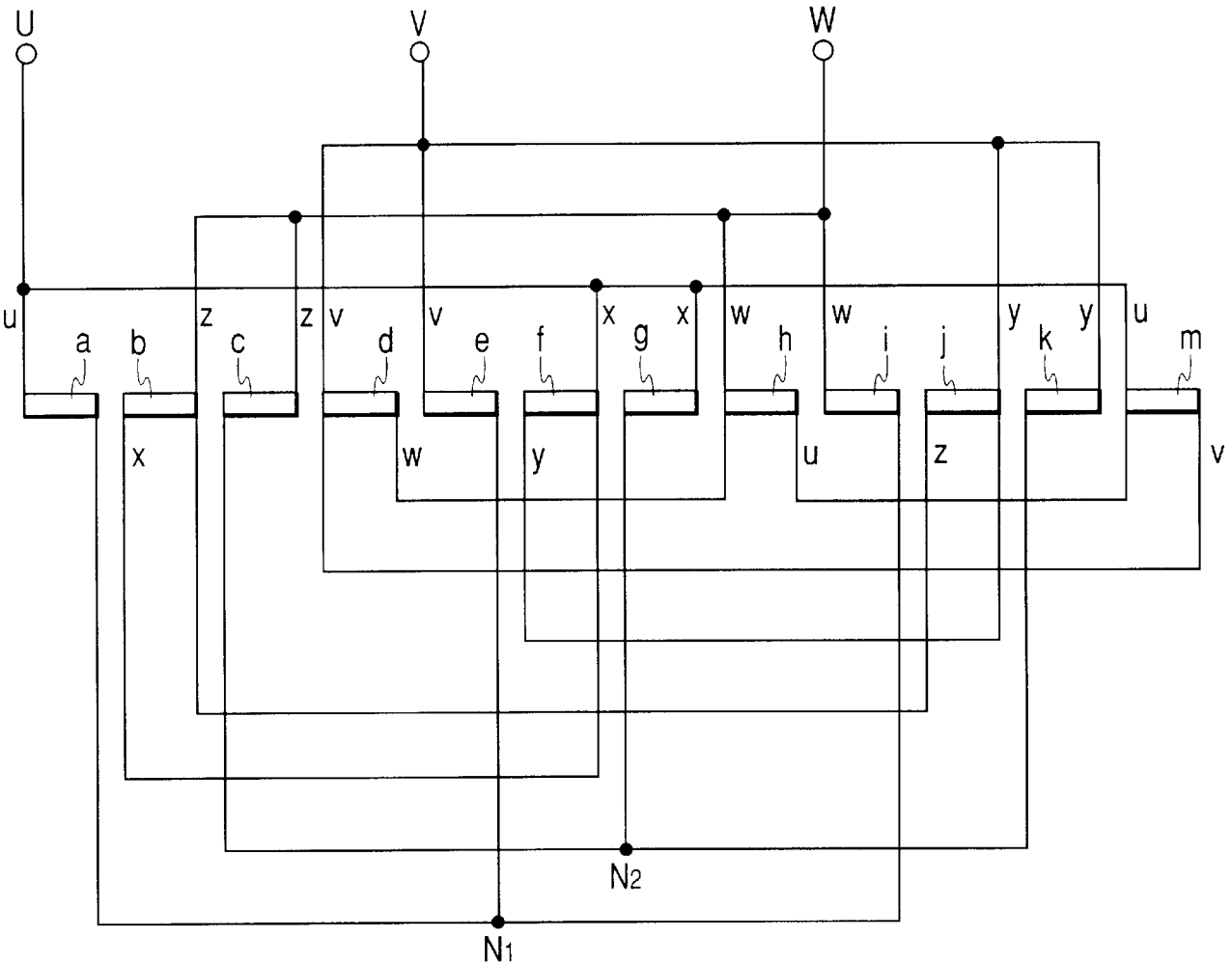
FIG. 4 is a wiring diagram showing the induction coils in the FIG. 1, which are arranged in the phase rotation direction.

Then, the induction coils b, f, j of the third group are successively disposed adjacent to the induction coils a, e, i of the second group as viewed in the phase rotation direction. Finally, the induction coils c, g, k of the fourth group are successively disposed adjacent to the induction coils b, f, j of the third group as viewed in the phase rotation direction. The induction coils thus disposed are as shown in FIG. 4. In this case, a starting point in the coil disposing order may be set at any point, and the coil disposing order may be reverse to the above-mentioned one.

When the induction coils are axially disposed within the roll 1 as in the above-mentioned fashion, and are excited by a three-phase power source, a phase difference between the adjacent induction coils of those ones is 30°. Accordingly, a temperature on a roll surface area, which is located between the adjacent induction coils while facing the latter, is extremely small, and a roll surface temperature is uniformly distributed over its entire surface.

Assuming that a line-to-line voltage among the U-, V- and W-phases is E and the phase current is I, then voltage Ed applied to the induction coils of the first and third groups is E, and voltage Es applied to the induction coils of the second and fourth groups is $E/\sqrt{3}$, (hence, $E=\sqrt{3}\times Es$). The phase current branches off in flow to the induction coils of the first to fourth groups. Accordingly, current Id flowing into the induction coils of the first and third groups is $I/4\sqrt{3}$ (hence, $I=4\times\sqrt{3}\times Id$), and current Is flowing into the induction coils of the second and fourth groups is I/4 (hence, $I=4\times Is$).

In order that when the rolls are inductively heated by exciting the related induction coils, the heating temperatures of the rolls are equal to one another, the number of turns, coil width, resistance values and the like of the induction coils are selected so that the induction coils have an equal ampere turn of the induction coil per unit length of the roll surface. Accordingly, the capacity P1 (VA) of the induction coils of the first and third groups is given by $$P1=2\times\sqrt{3}\times E\times(I/4)=2\times\sqrt{3}\times E\times(1/4)\times 4\times\sqrt{3}\times Id=6\times E\times Id$$

The capacity P2 of the induction coils of the second and fourth groups is given by $$P2=2\times\sqrt{3}\times E\times(I/4)=2\times\sqrt{3}\times\sqrt{3}\times Es\times(1/4)\times 4\times Is=6\times Es\times Is$$

Hence, the capacity P of all the induction coils is $$P=P1+P2=\sqrt{3}\times E\times I=6\times E\times Id+6\times Es\times Is$$

Figure 6:
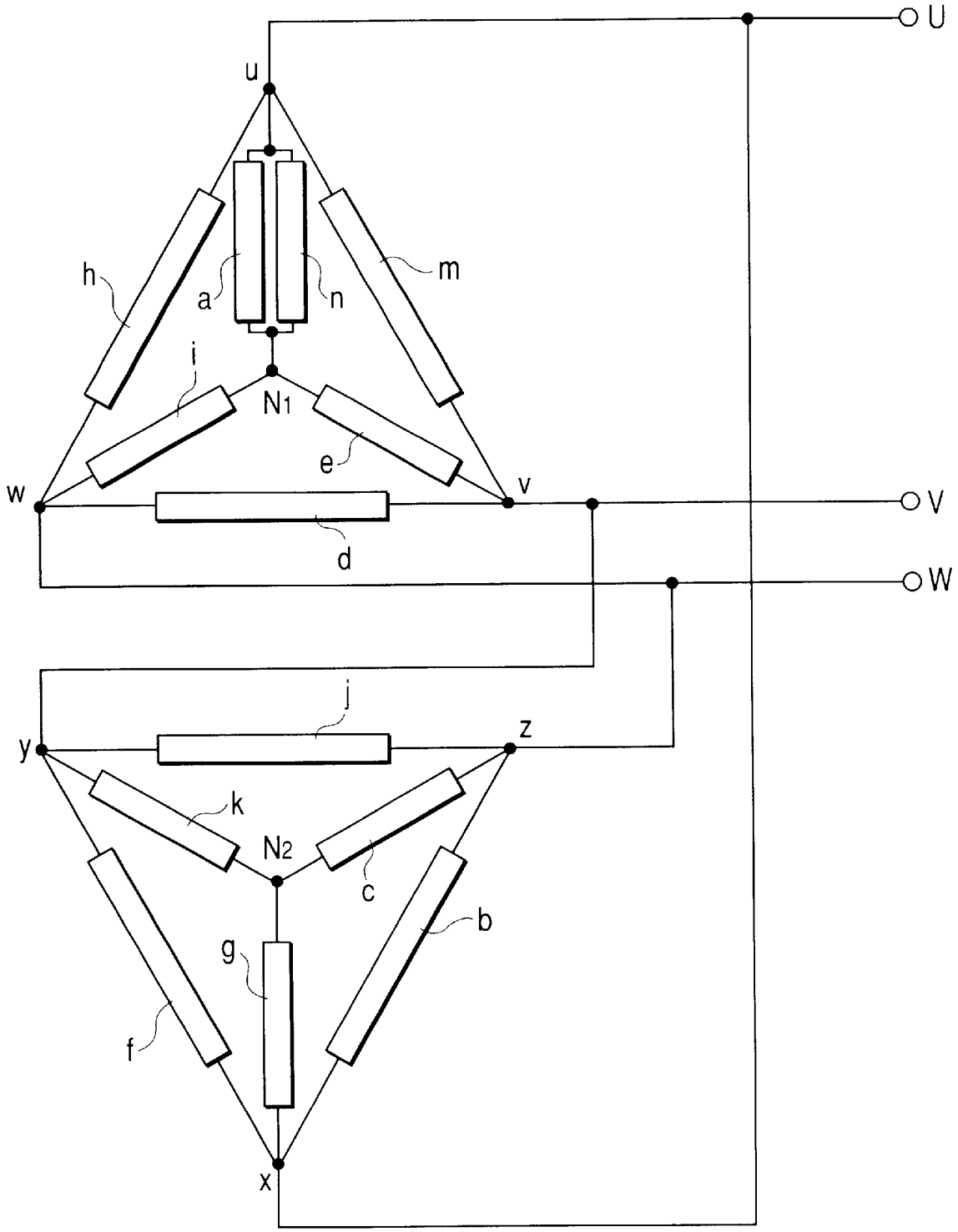
FIG. 6 is a wiring diagram showing a second embodiment of the present invention.
Figure 7:
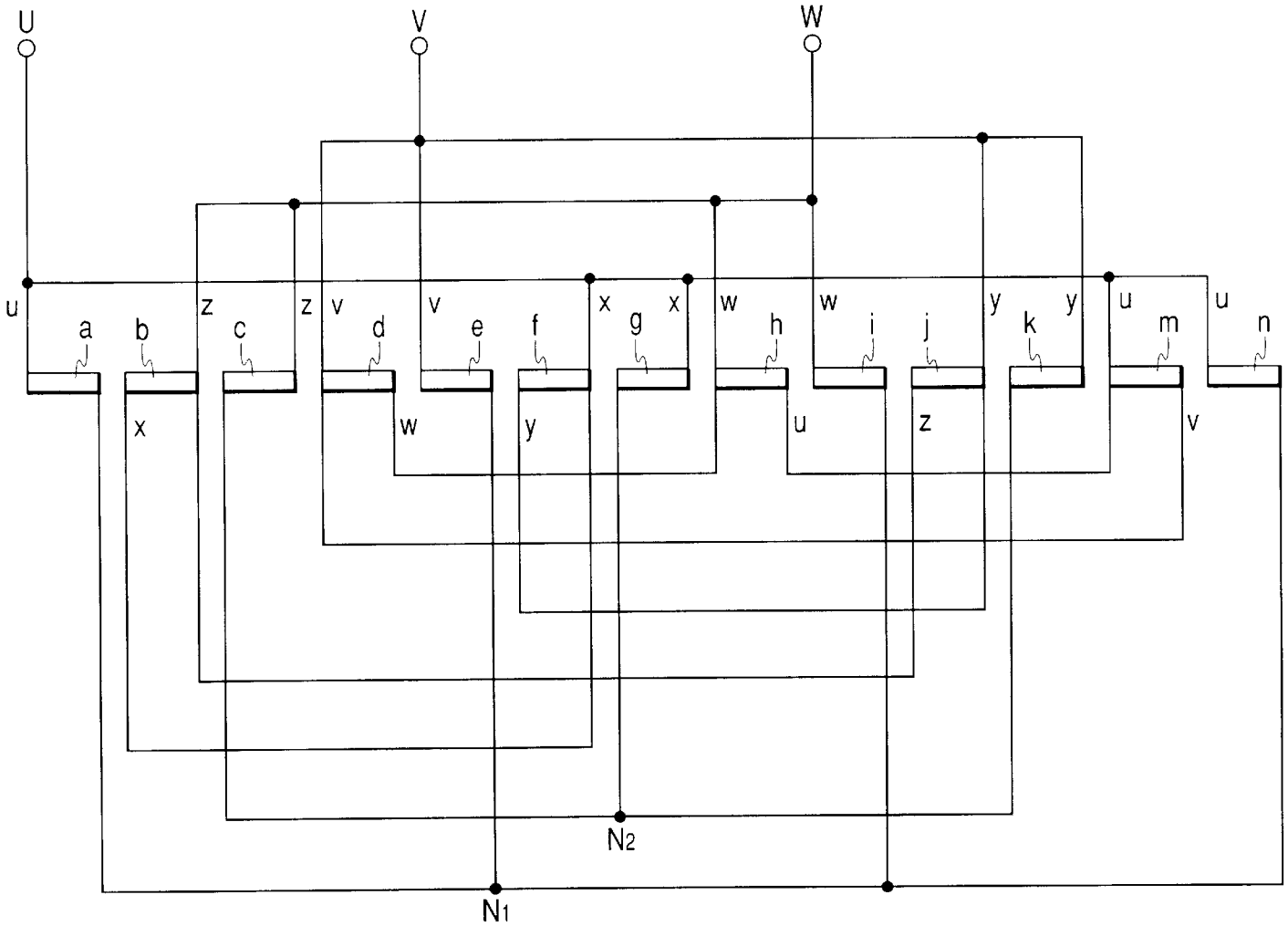
FIG. 7 is a wiring diagram showing the induction coils in the FIG. 6, which are arranged in the phase rotation direction.
Figure 8:
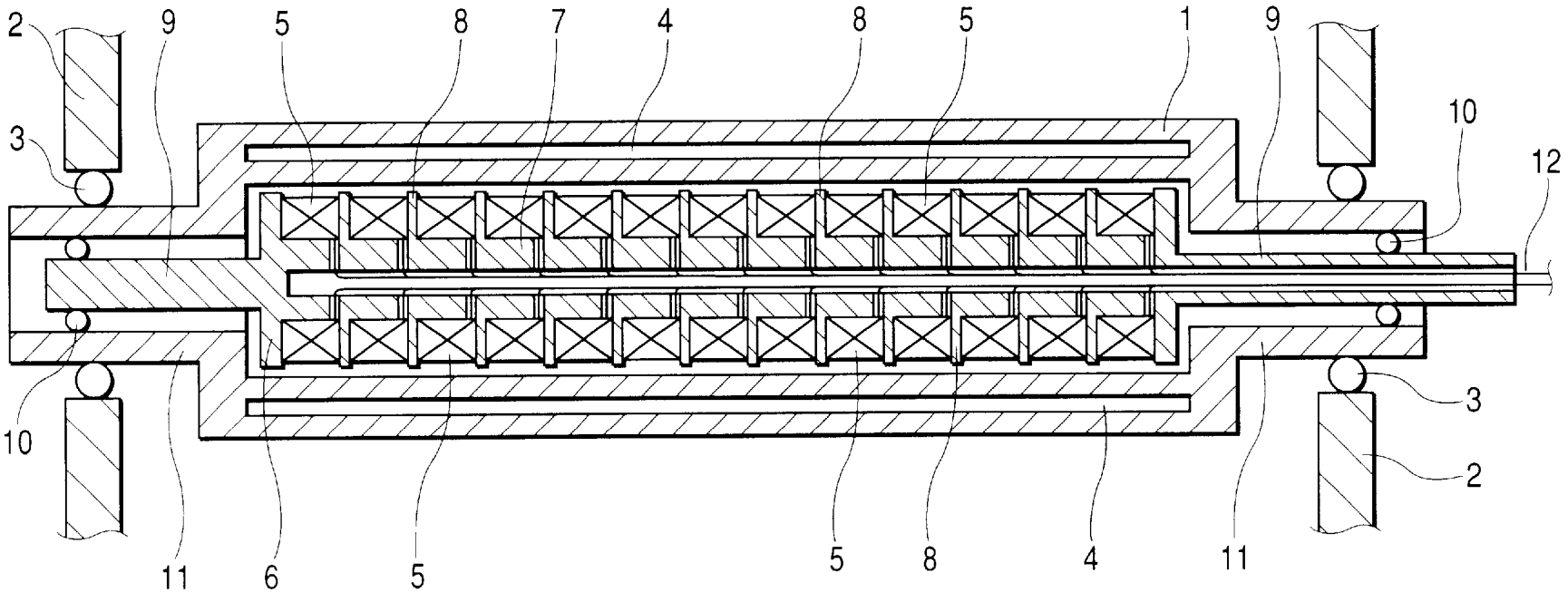
FIG. 8 is a cross sectional view showing an induction-heated roller device used in the FIG. 6.

FIG. 6 is a wiring diagram showing a second embodiment of the present invention. FIG. 7 is a wiring diagram showing the induction coils in the FIG. 6, which are arranged in the phase rotation direction. FIG. 8 is a cross sectional view showing an induction-heated roller device used in the FIG. 6. The second embodiment of the induction-heated roller device shown in FIGS. 6 to 8 will now be described in detail. In the embodiment, as shown in FIG. 6, an induction coil n is connected in parallel with an induction coil a star connected to the three-phase power source.

The induction coil n is connected between a tap u of the U-phase and a neutral point N1 of the star connection, as shown in the wiring diagram of FIG. 7. The wiring of this induction coil is the same as of the induction coil a, and hence a magnitude and a direction of a voltage vector of it are equal to those of the induction coil a. In FIG. 2, the voltage vector of the induction coil a is directed from the point u to the neutral point N1, and its magnitude is expressed by a length from the point u to the point N1. A magnitude (length) and a direction of a voltage vector of the induction coil n are also depicted so.

Figure 1:
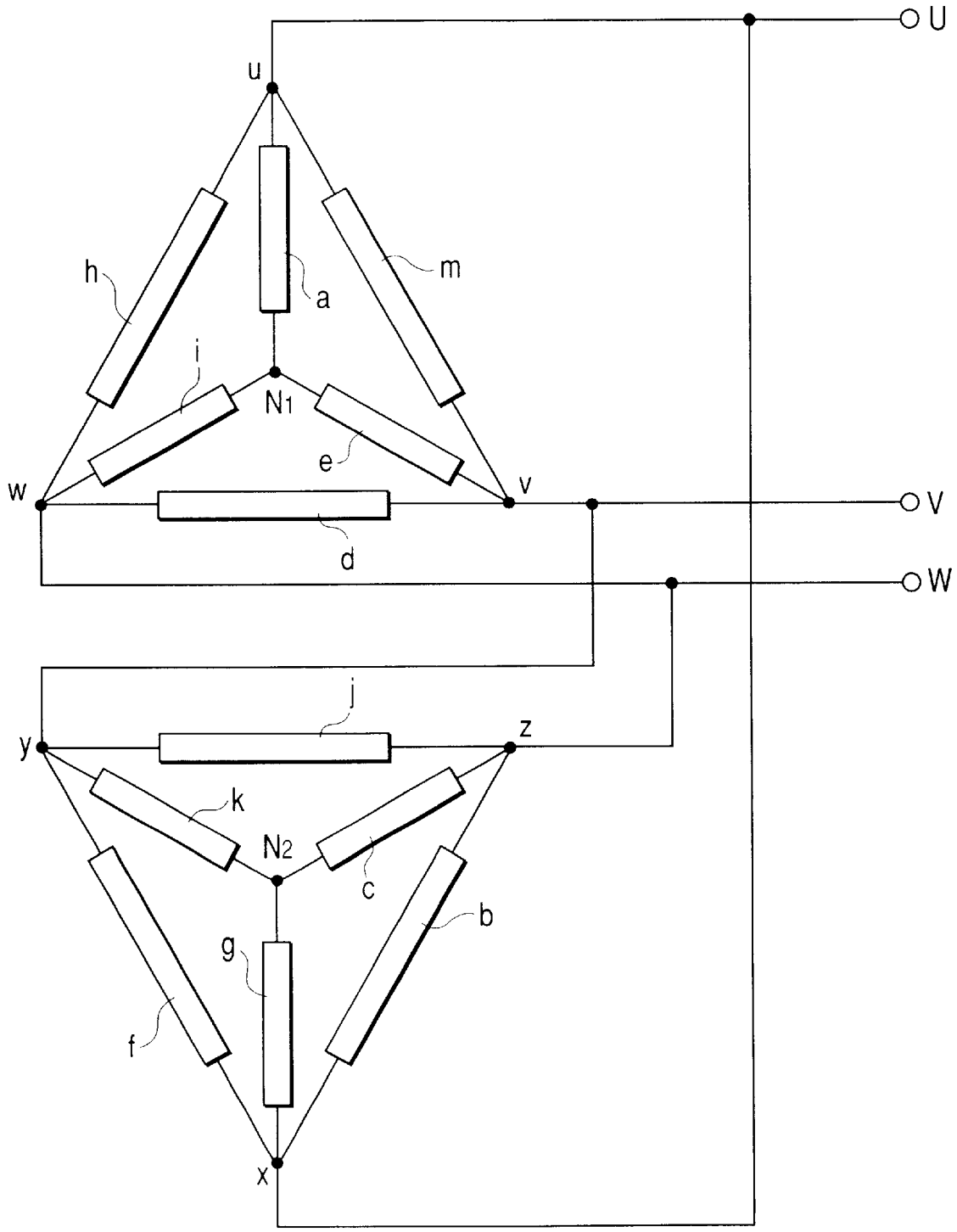
FIG. 1 is a wiring diagram showing a first embodiment of the present invention.

As shown in FIG. 7, the induction coil n is additionally connected to the twelve induction coils shown in FIG. 1, so that a total number of induction coils is 13. Those thirteen induction coils 5 thus wired are axially wound on an iron core 6 within a hollow space of a roll 1, as shown in FIG. 8. Since the thirteen induction coils are used, the induction-heated roller device of the embodiment is well fit to the roll length and the heat distribution characteristic of the roll surface heated, although the induction-heated roller device using the twelve induction coils is not so.

In the embodiment of FIG. 6, the induction coil n is connected in parallel with the induction coil a of the star connection. If required, the induction coil n may be connected in parallel with any of other induction coils. More exactly, the induction coil n may be connected in parallel with any of other induction coils e and i of the star connection, and the induction coils c, g, k star connected to the three-phase power source 180° phase-shifted. If necessary, the induction coil n may be connected in parallel with any of the induction coils m, d, h delta connected to the three-phase power source or any of the induction coils b, f, j delta connected to the three-phase power source 180° phase-shifted.

Figure 9:
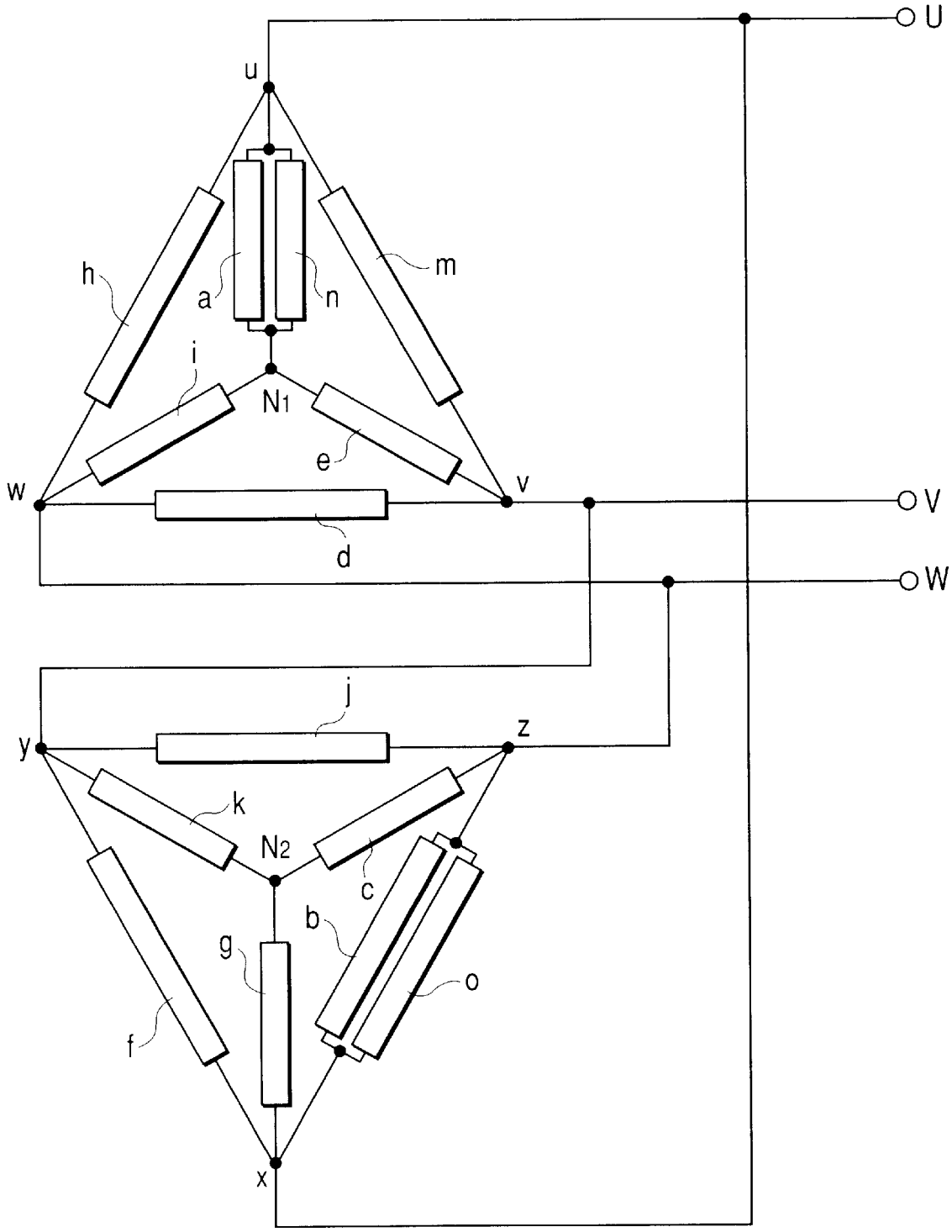
FIG. 9 is a wiring diagram showing a third embodiment of the present invention.
Figure 10:
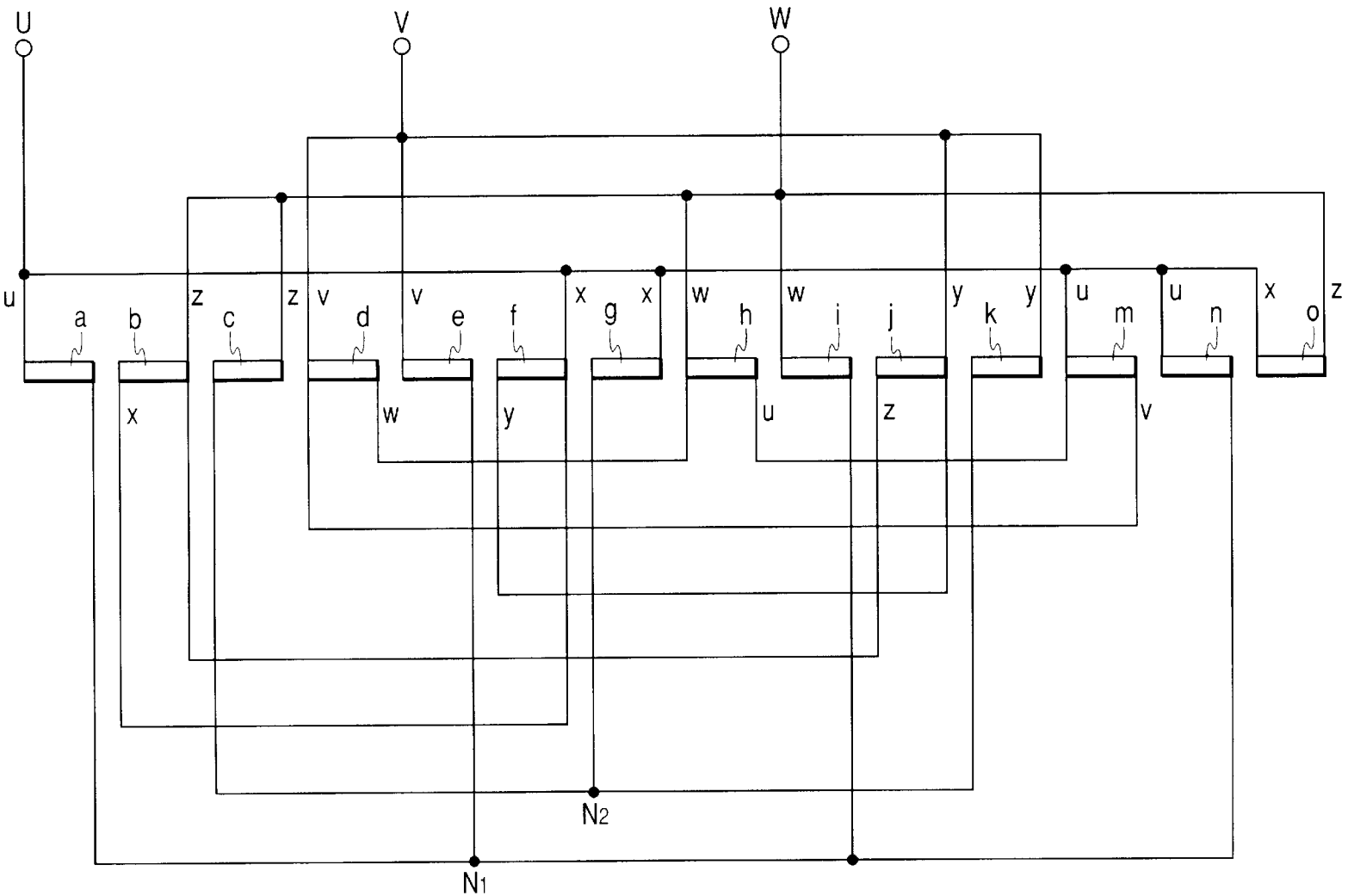
FIG. 10 is a wiring diagram showing the induction coils in the FIG. 9, which are arranged in the phase rotation direction.

FIG. 9 is a wiring diagram showing a third embodiment of the present invention. FIG. 10 is a wiring diagram showing the induction coils in the FIG. 9, which are arranged in the phase rotation direction. The third embodiment of the invention will be described with reference to FIGS. 9 and 10. As shown in FIG. 9, in this embodiment, an induction coil n is connected in parallel with the induction coil a star connected to the three-phase power source, and an induction coil o is connected in parallel with the induction coil b delta connected to the three-phase power source 180° phase-shifted.

A magnitude and a direction of a voltage vector of the induction coil n are the same as of the voltage vector of the induction coil a. A magnitude and a direction of a voltage vector of the induction coil o are the same as of the voltage vector of the induction coil b. This is also seen from the fact that as shown in the wiring diagram of FIG. 10, the induction coils b and o are connected to the taps x and z of the three-phase power source which receives the 180° phase-shifted U-, V- and W-phase voltages of the three-phase power source.

Since the induction coils n and o are additionally connected to the twelve induction coils, a total number of induction coils in the induction-heated roller device is 14. In this case, although not illustrated, the fourteen induction coils 5 are axially wound on the iron core 6 within the hollow space (FIG. 5). The induction-heated roller device using the fourteen induction coils is also well fit to the roll length and the heat distribution characteristic of the roll surface heated, although the induction-heated roller device using the twelve induction coils is not so.

In the FIG. 9, the induction coil n is connected in parallel with the induction coil a star connected to the three-phase power source, and the induction coil o is connected in parallel with the induction coil b delta connected to the three-phase power source 180° phase-shifted. If required, the induction coils n and o may be connected in parallel with any of other induction coils in the connection manner as described above. More exactly, the induction coils may be connected in parallel with any of other induction coils e and i of the star connection, and the induction coils c, g, k star connected to the three-phase power source 180° phase-shifted. If necessary, the induction coils may be connected in parallel with any of the induction coils m, d, h delta connected to the three-phase power source or any of the induction coils f, j delta connected to the three-phase power source 180° phase-shifted.

Figure 11:
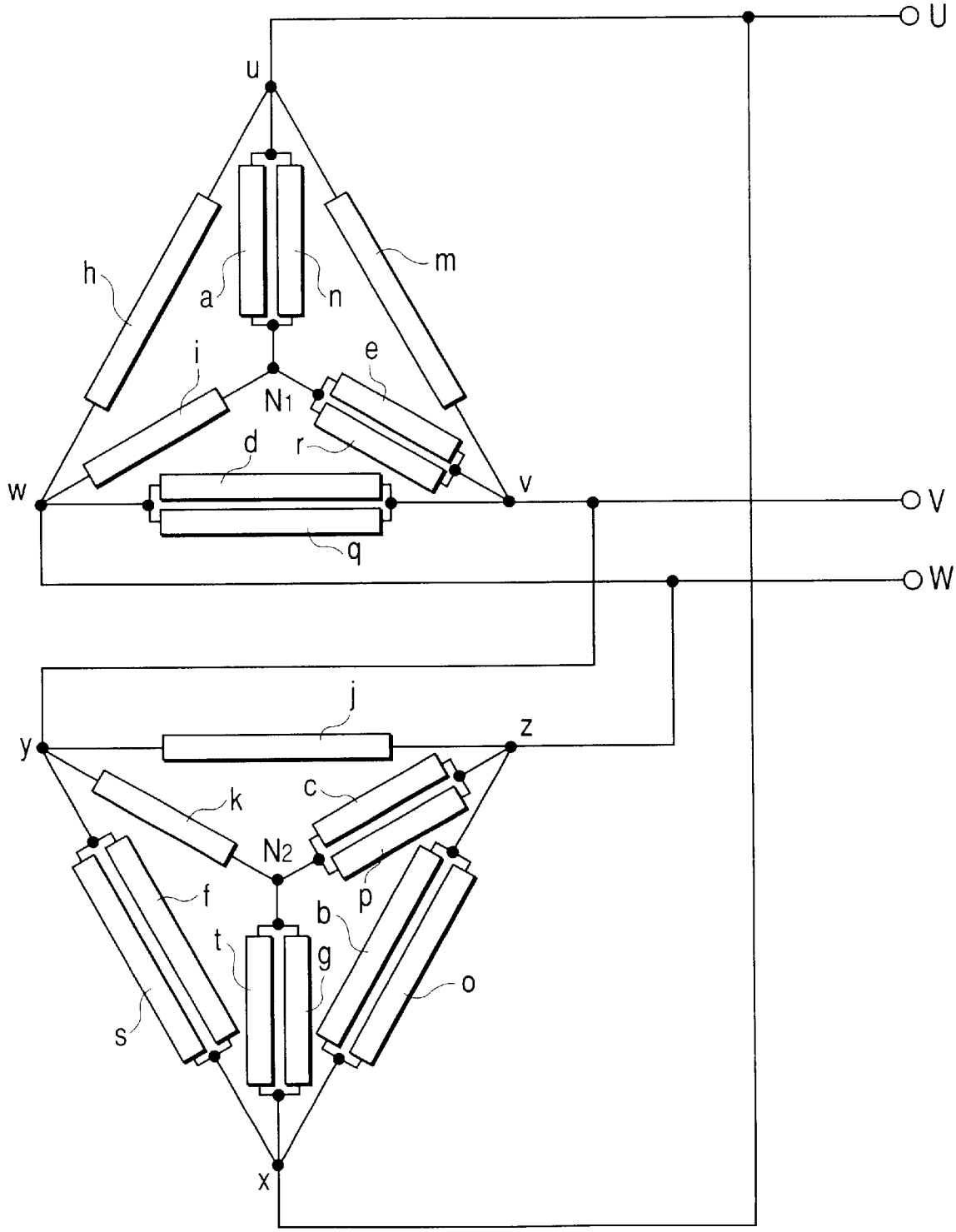
FIG. 11 is a wiring diagram showing a fourth embodiment of the present invention.
Figure 12:
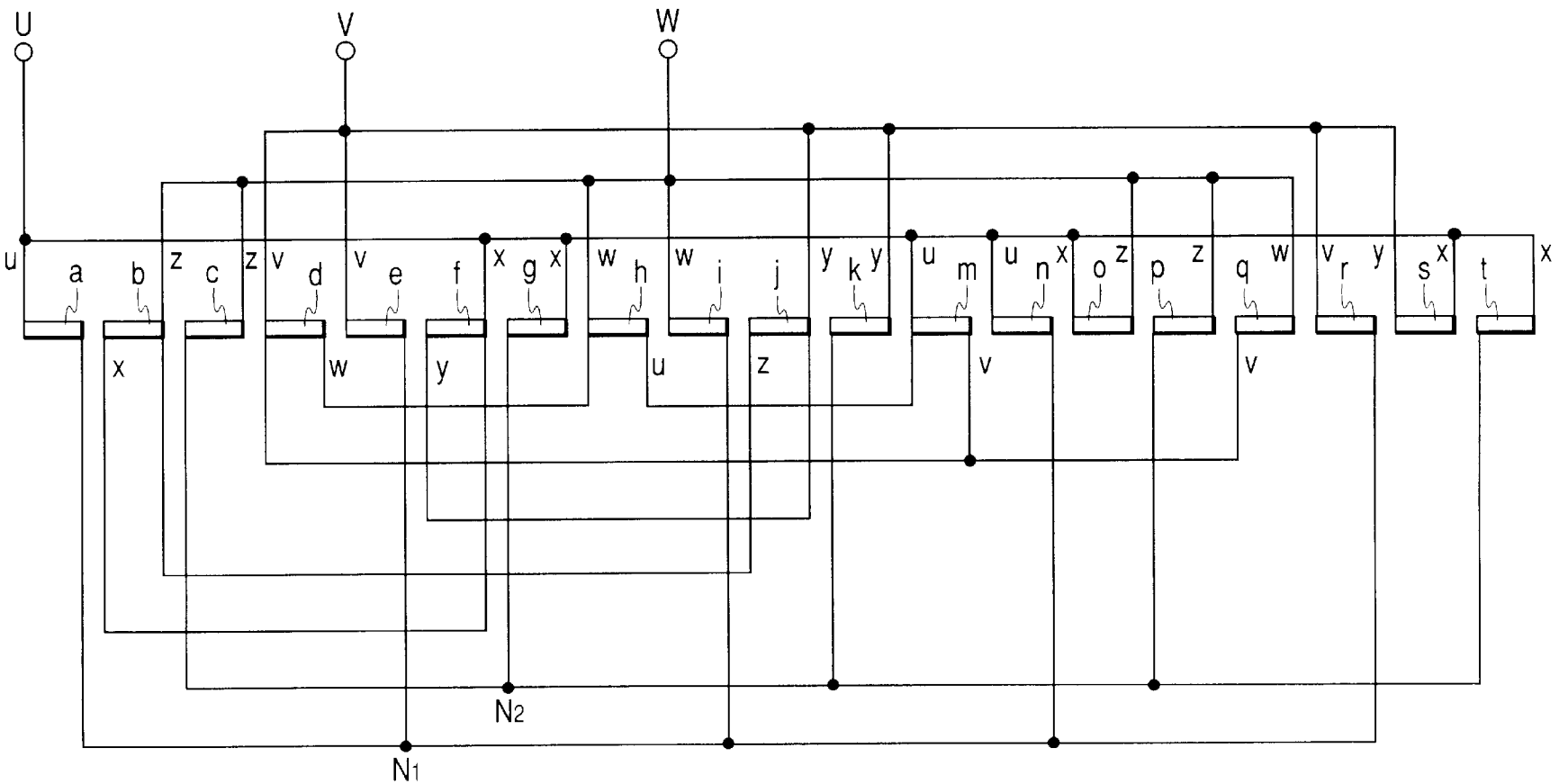
FIG. 12 is a wiring diagram showing the induction coils in the FIG. 11, which are arranged in the phase rotation direction.

FIG. 11 is a wiring diagram showing a fourth embodiment of the present invention. FIG. 12 is a wiring diagram showing the induction coils in the FIG. 11, which are arranged in the phase rotation direction. The fourth embodiment of the induction-heated roller device shown in FIGS. 11 to 12 will now be described in detail. In the embodiment, as shown in FIG. 11, an induction coil n is connected in parallel with an induction coil a star connected to the three-phase power source, and an induction coil r is connected in parallel with the induction coil e star connected to the three-phase power source. An induction coil q is connected in parallel with the induction coil d delta connected to the three-phase power source.

An induction coil t is connected in parallel with the induction coil g star connected the 180° phase-shifted three-phase power source, and an induction coil p is connected in parallel with the induction coil c star connected the 180° phase-shifted three-phase power source. An induction coil o is connected in parallel with the induction coil b delta connected the 180° phase-shifted three-phase power source, and an induction coil s is connected in parallel with the induction coil f delta connected the 180° phase-shifted three-phase power source.

As seen from the wiring diagram of FIG. 12, a magnitude and a direction of a voltage vector of any of the additionally connected induction coils n, r, q are equal to those of one of those induction coils a, e, d originally connected, for the same reason described in FIG. 10. A magnitude and a direction of a voltage vector of any of the additionally connected induction coils p, t, o, s are also equal to those of one of those induction coils c, g, b, f originally connected.

In the embodiments of FIGS. 6 to 12, the induction coils are additionally connected in parallel with some of the twelve induction coils. If required, induction coils may be connected in parallel with all of the twelve induction coils, respectively. Two or more number of the additional induction coils may be connected in parallel with the original ones. A total number of induction coils is appropriately determined taking the roll length, the roll surface heat distribution characteristic into account. Thus, in the present invention, an x number of induction coils (x: an integer of 1 or greater) are connected in parallel with any of 1 to 12 of the twelve induction coils originally connected.

In the embodiments of FIGS. 6 to 12, a total number of induction coils is increased by additionally connecting one or more number of induction coils in parallel with any of 1 to 12 of the twelve induction coils originally connected. It will be understand that the present invention holds in a case where the number of induction coils is smaller than 12 if the induction coils are disposed so that a phase difference between the voltages applied to the adjacent induction coils is 30°.

Figure 13:
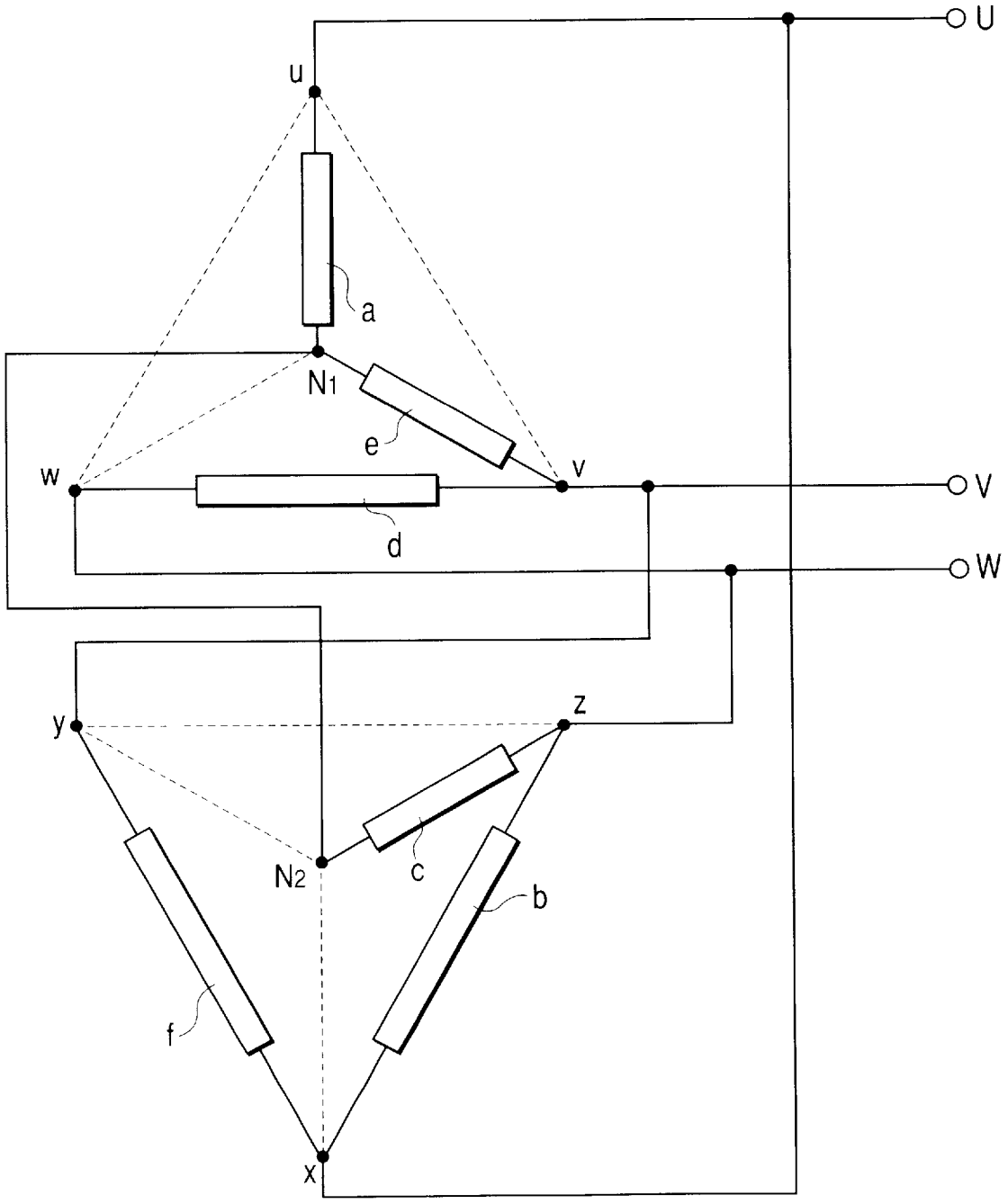
FIG. 13 is a wiring diagram showing a fifth embodiment of the present invention.
Figure 14:
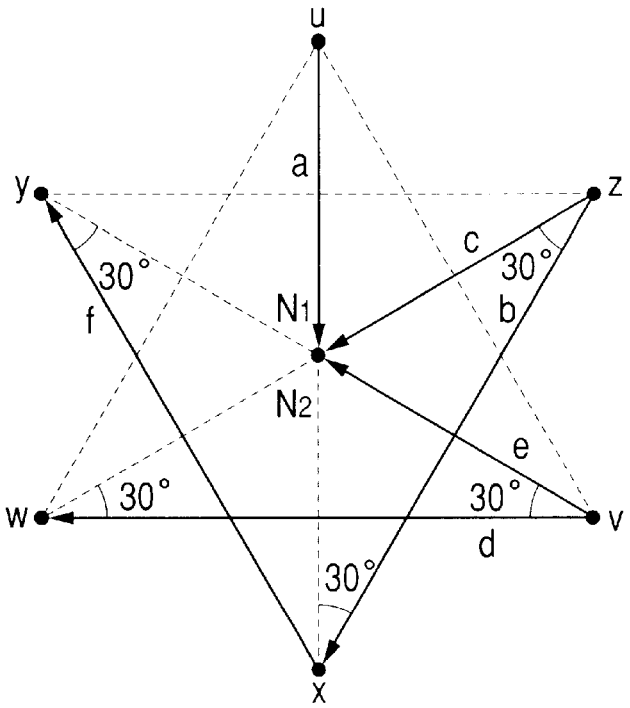
FIG. 14 is a vector diagram of the voltages in the FIG. 13.
Figure 15:
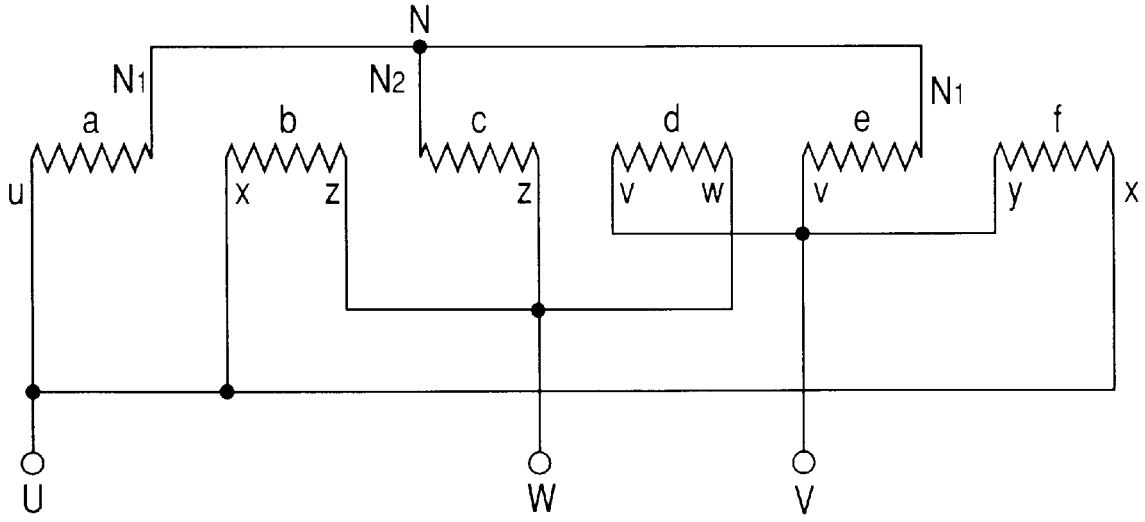
FIG. 15 is a wiring diagram showing the induction coils in the FIG. 13, which are arranged in the phase rotation direction.
Figure 16:
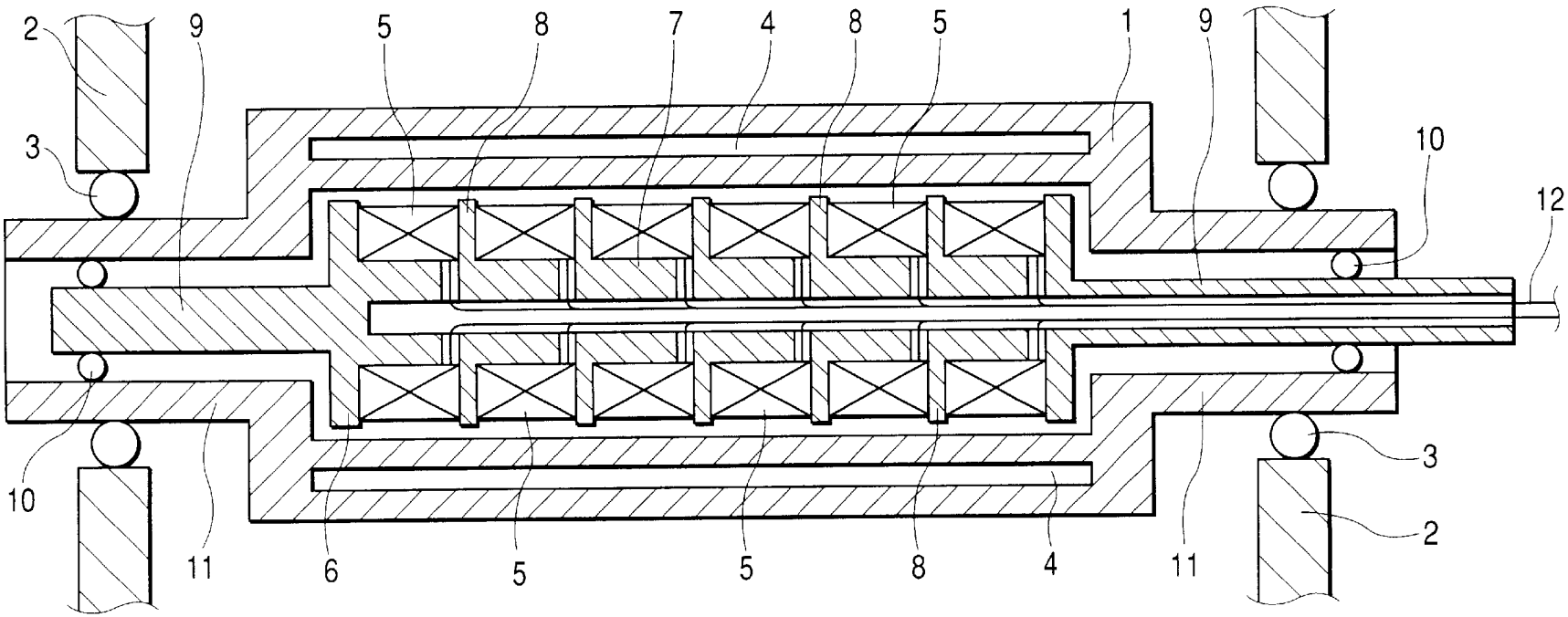
FIG. 16 is a cross sectional view showing an induction-heated roller device used in the FIG. 13.

FIG. 13 is a wiring diagram showing a fifth embodiment of the present invention. FIG. 14 is a vector diagram of the voltages in the FIG. 13. FIG. 15 is a wiring diagram showing the induction coils in the FIG. 13, which are arranged in the phase rotation direction. FIG. 16 is a cross sectional view showing an induction-heated roller device used in the FIG. 13.

An induction-heated roller device shown in FIGS. 13 through 16 will be described. In the embodiment, the induction coil i star connected to the three-phase power source in the wiring diagram of FIG. 1, and the induction coils m and h delta connected to the three-phase power source are omitted. Further, the induction coils g, k star connected to the three-phase power source 180° phase shifted are also omitted. Additionally, the induction coil j delta connected to the three-phase power source 180° phase shifted is omitted. Thus, six induction coils are omitted from those twelve induction coils. Accordingly, a total number of induction coils forming the induction-heated roller device is 6.

Referring to the FIG. 14 vector diagram and the FIG. 15 wiring diagram, a phase difference between the voltages applied to the adjacent induction coils is 30° also in the wiring as shown in FIG. 13. As seen from the vector diagram of FIG. 14, a phase difference between the voltages applied to the adjacently disposed induction coils (a, b), (b, c), (c, d), (d, e), and (e, f), is 30°.

In the embodiment, the six induction coils 5, as shown in FIG. 16, are axially wound on an iron core 6 within a hollow space of a roll 1. Thus, also in the induction-heated roller device using six induction coils, a phase difference between the voltages applied to the adjacent induction coils is 30°. The roll surface temperature distribution is made uniform not using the multiphase transformer, which is essential in the conventional technique. In the induction-heated roller device of this embodiment, the number of induction coils is reduced when comparing with the FIG. 1 embodiment. This leads to easy manufacturing and cost reduction.

Figure 17:
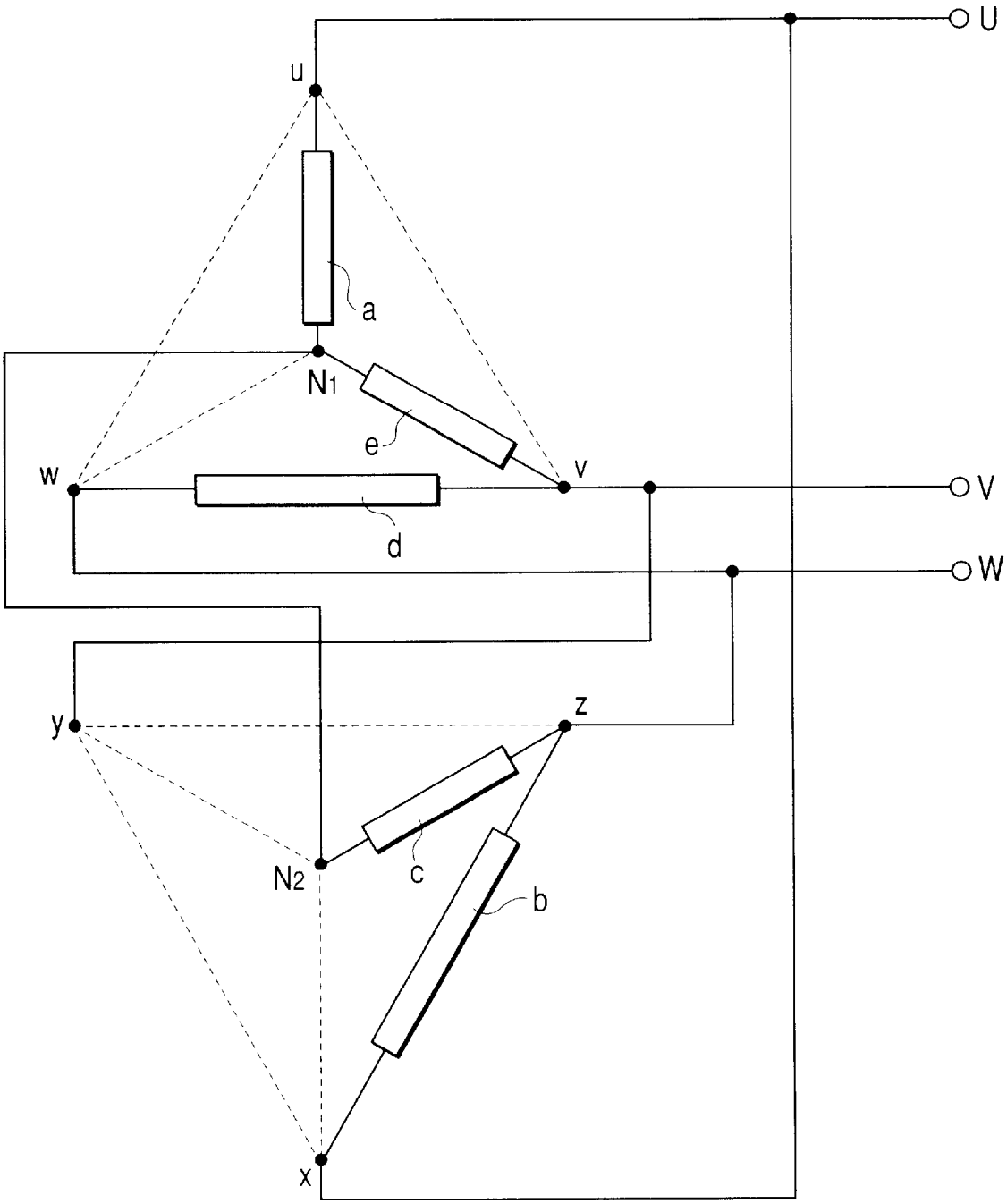
FIG. 17 is a wiring diagram showing a sixth embodiment of the present invention.
Figure 18:
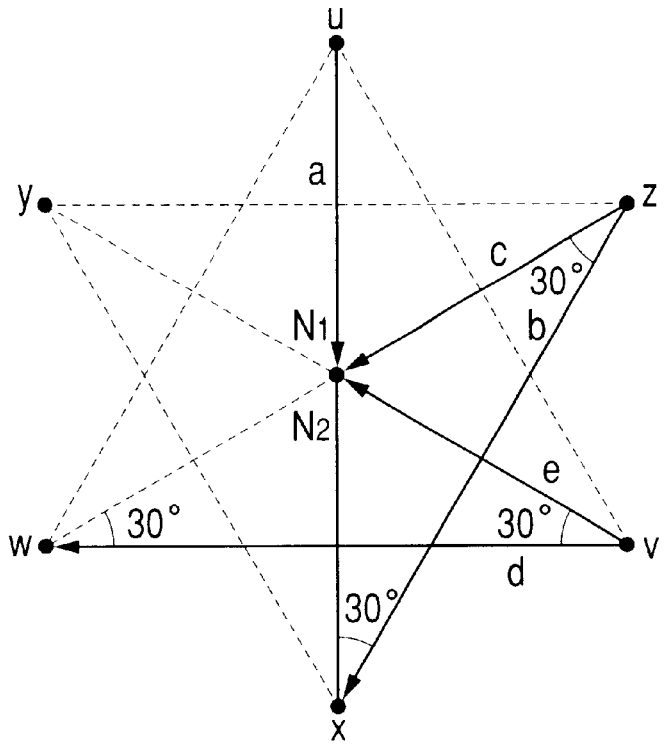
FIG. 18 is a vector diagram of the voltages in the FIG. 17.
Figure 19:
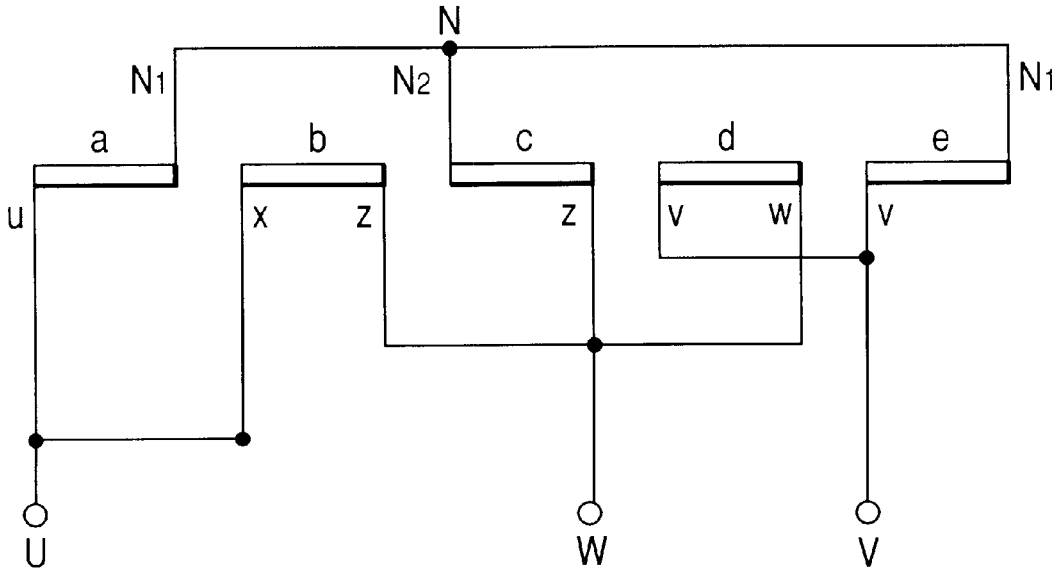
FIG. 19 is a wiring diagram showing the induction coils in the FIG. 17, which are arranged in the phase rotation direction.
Figure 20:
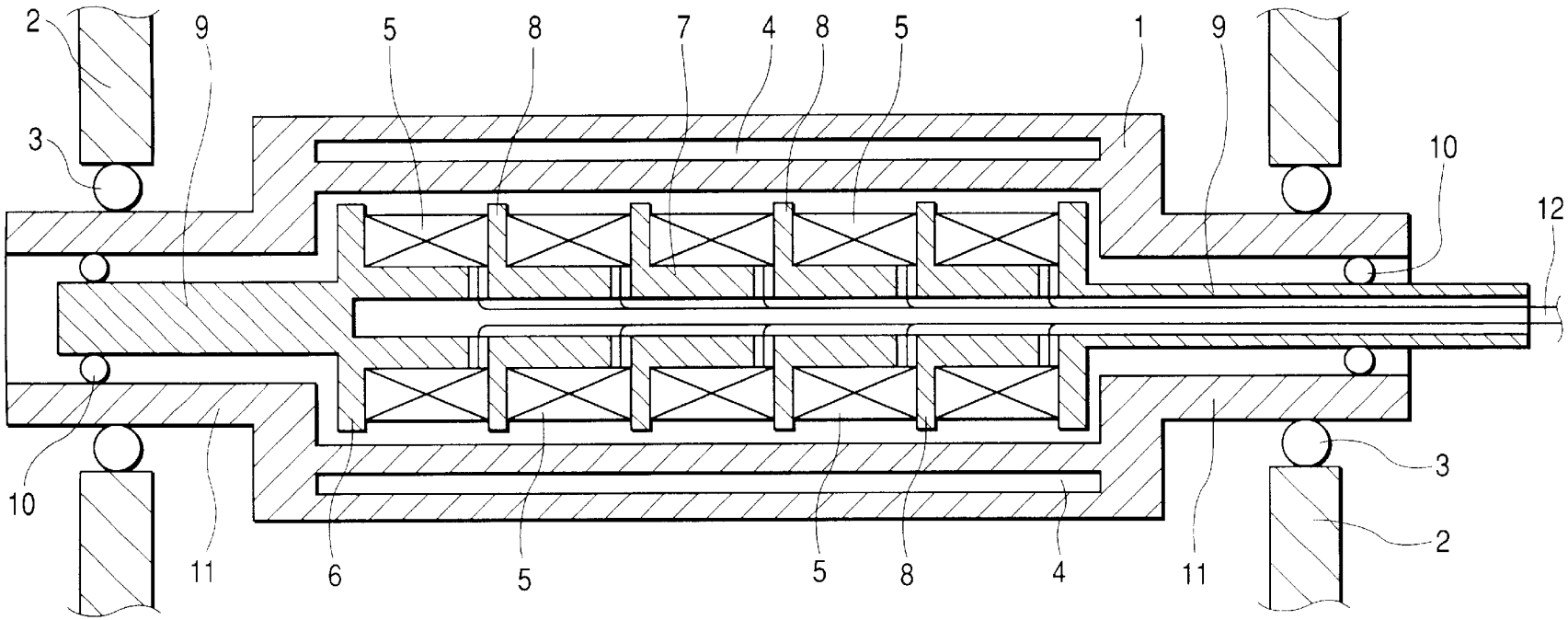
FIG. 20 is a cross sectional view showing an induction-heated roller device used in the FIG. 17.

FIG. 17 is a wiring diagram showing a sixth embodiment of the present invention. FIG. 18 is a vector diagram of the voltages in the FIG. 17. FIG. 19 is a wiring diagram showing the induction coils in the FIG. 17, which are arranged in the phase rotation direction. FIG. 20 is a cross sectional view showing an induction-heated roller device used in the FIG. 17.

An induction-heated roller device shown in FIGS. 17 through 20 will be described. In the embodiment, the induction coil i star connected to the three-phase power source in the wiring diagram of FIG. 1, and the induction coils m and h delta connected to the three-phase power source are omitted. Further, the induction coils g, k star connected to the three-phase power source 180° phase shifted are also omitted. Additionally, the induction coils j, f delta connected to the three-phase power source 180° phase shifted is omitted. Thus, seven induction coils are omitted from those twelve induction coils. Accordingly, a total number of induction coils forming the induction-heated roller device is 5.

Referring to the FIG. 18 vector diagram and the FIG. 19 wiring diagram, a phase difference between the voltages applied to the adjacent induction coils is 30° also in the wiring including five induction coils as shown in FIG. 17. As seen from the vector diagram of FIG. 18, a phase difference between the voltages applied to the adjacently disposed induction coils (a, b), (b, c), (c, d), and (d, e) is 30°.

In the embodiment, the five induction coils 5, as shown in FIG. 20, are axially wound on an iron core 6 within a hollow space of a roll 1. Thus, also in the induction-heated roller device using five induction coils, a phase difference between the voltages applied to the adjacent induction coils is 30°. The roll surface temperature distribution is made uniform not using the multiphase transformer. Further, since the number of induction coils is reduced, the manufacturing is easy and the cost to manufacture is reduced.

Figure 21:
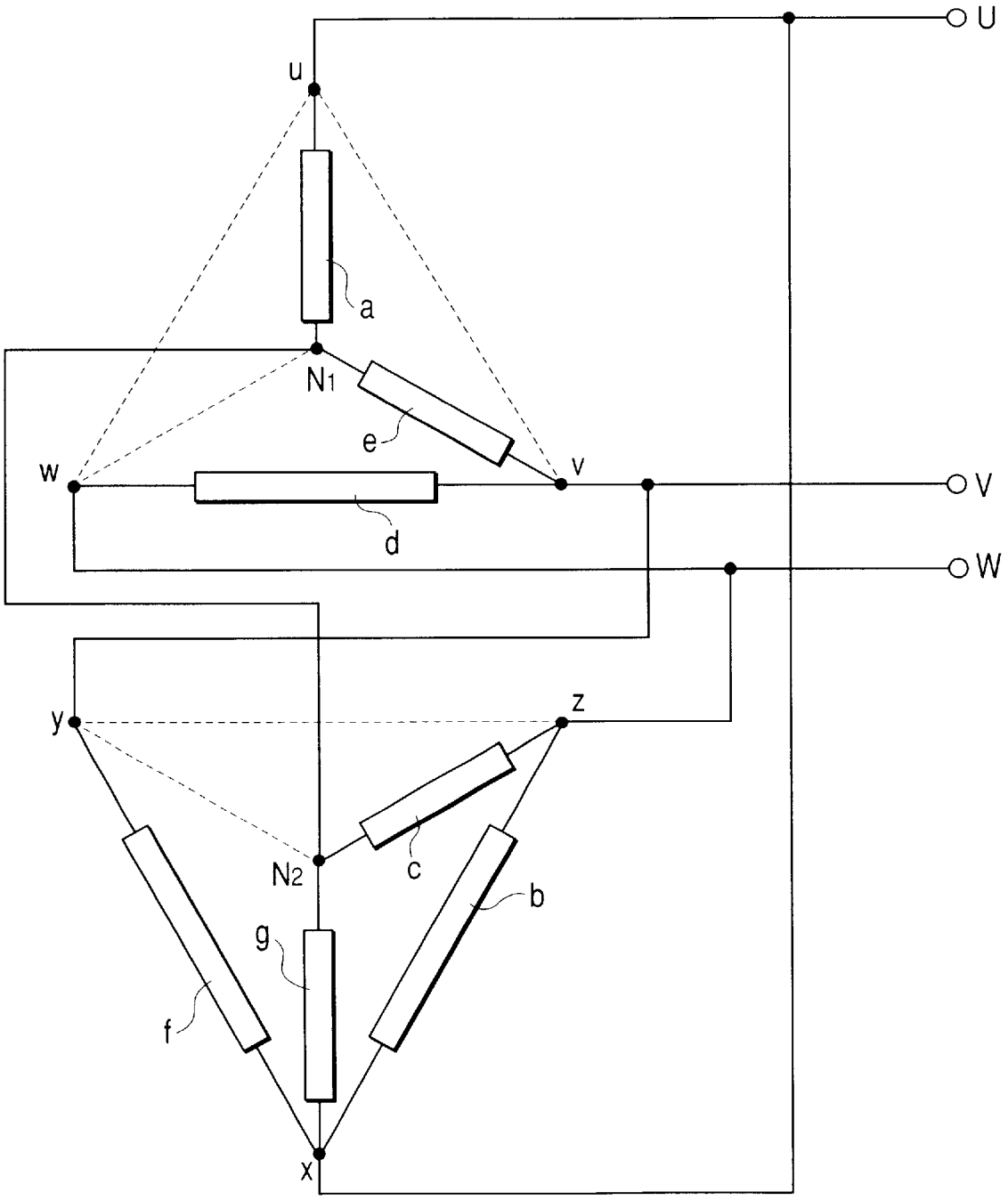
FIG. 21 is a wiring diagram showing a seventh embodiment of the present invention.
Figure 22:
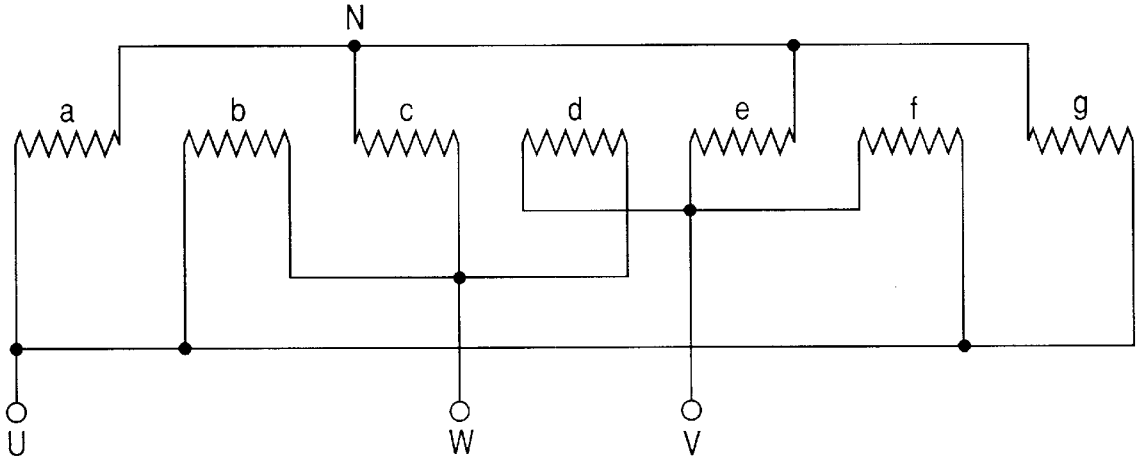
FIG. 22 is a wiring diagram showing the induction coils in the FIG. 21, which are arranged in the phase rotation direction.

FIG. 21 is a wiring diagram showing a seventh embodiment of the present invention. FIG. 22 is a wiring diagram showing the induction coils in the FIG. 21, which are arranged in the phase rotation direction. FIG. 22 is a cross sectional view showing an induction-heated roller device used in the FIG. 21.

An induction-heated roller device shown in FIGS. 21 through 23 will be described. In the embodiment, the induction coil i star connected to the three-phase power source in the wiring diagram of FIG. 1, and the induction coils m and h delta connected to the three-phase power source are omitted. Further, the induction coil k star connected to the three-phase power source 180° phase shifted are also omitted. Additionally, the induction coil j delta connected to the three-phase power source 180° phase shifted is omitted. Thus, five induction coils are omitted from those twelve induction coils. Accordingly, a total number of induction coils forming the induction-heated roller device is 7.

As in the embodiment of FIGS. 13 through 20, a phase difference between the voltages applied to the adjacent induction coils is 30°, although a vector diagram is omitted in the FIG. 21 embodiment. In the wiring diagram of FIG. 22, a phase difference between the voltages applied to the adjacently disposed induction coils (a, b), (b, c), (c, d), (d, e), (e, f), and (f, g) is 30°.

Figure 23:
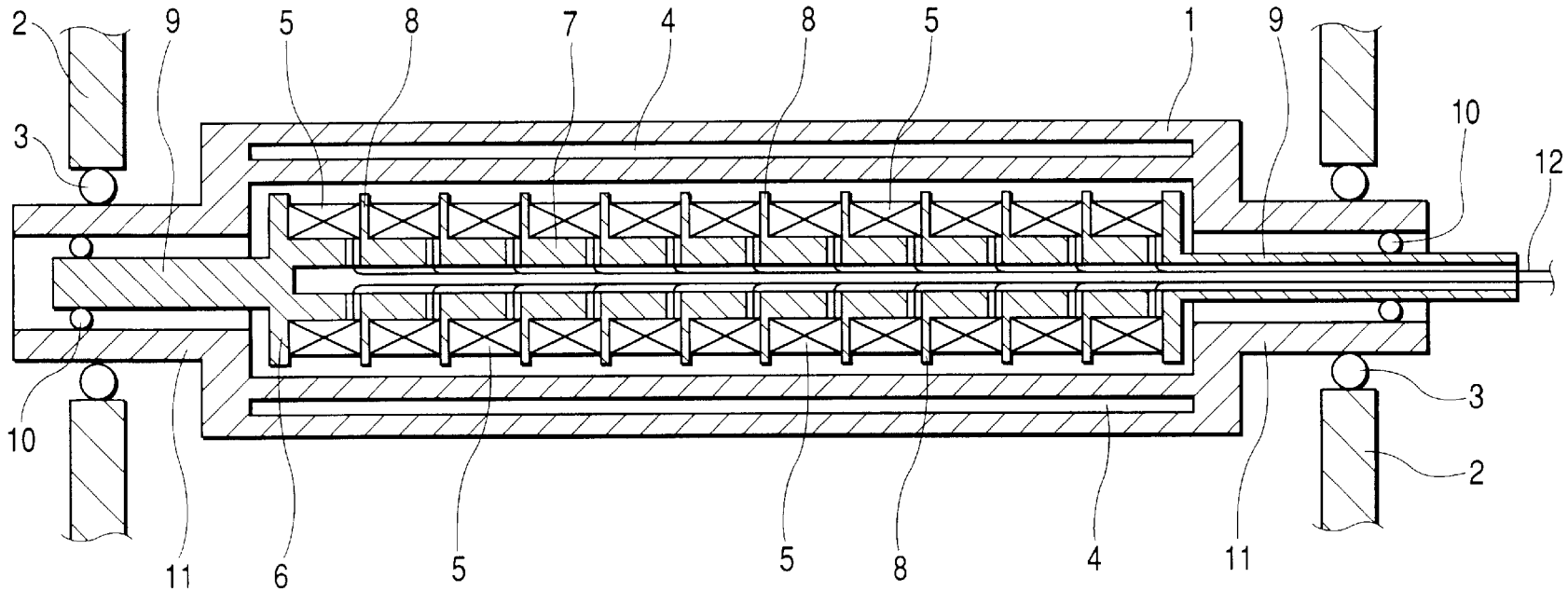
FIG. 23 is a cross sectional view showing an induction-heated roller device used in the FIG. 21.

In the embodiment, the seven induction coils 5, as shown in FIG. 23, are axially wound on an iron core 6 within a hollow space of a roll 1. Thus, also in the induction-heated roller device using seven induction coils, a phase difference between the voltages applied to the adjacent induction coils is 30°. The roll surface temperature distribution is made uniform not using the multiphase transformer, and the manufacturing is easy and the cost is reduced.

Figure 24:
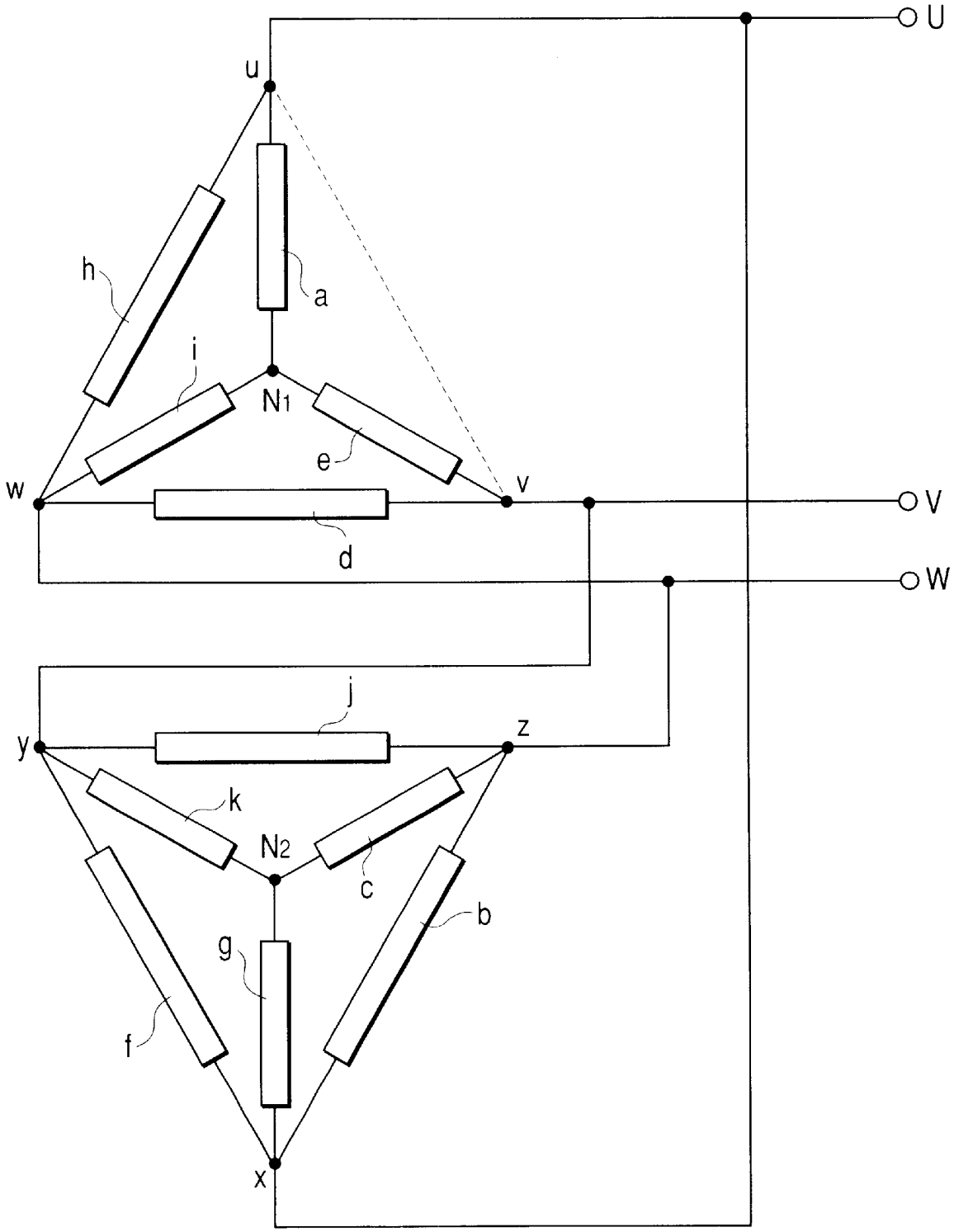
FIG. 24 is a wiring diagram showing an eighth embodiment of the present invention.
Figure 25:
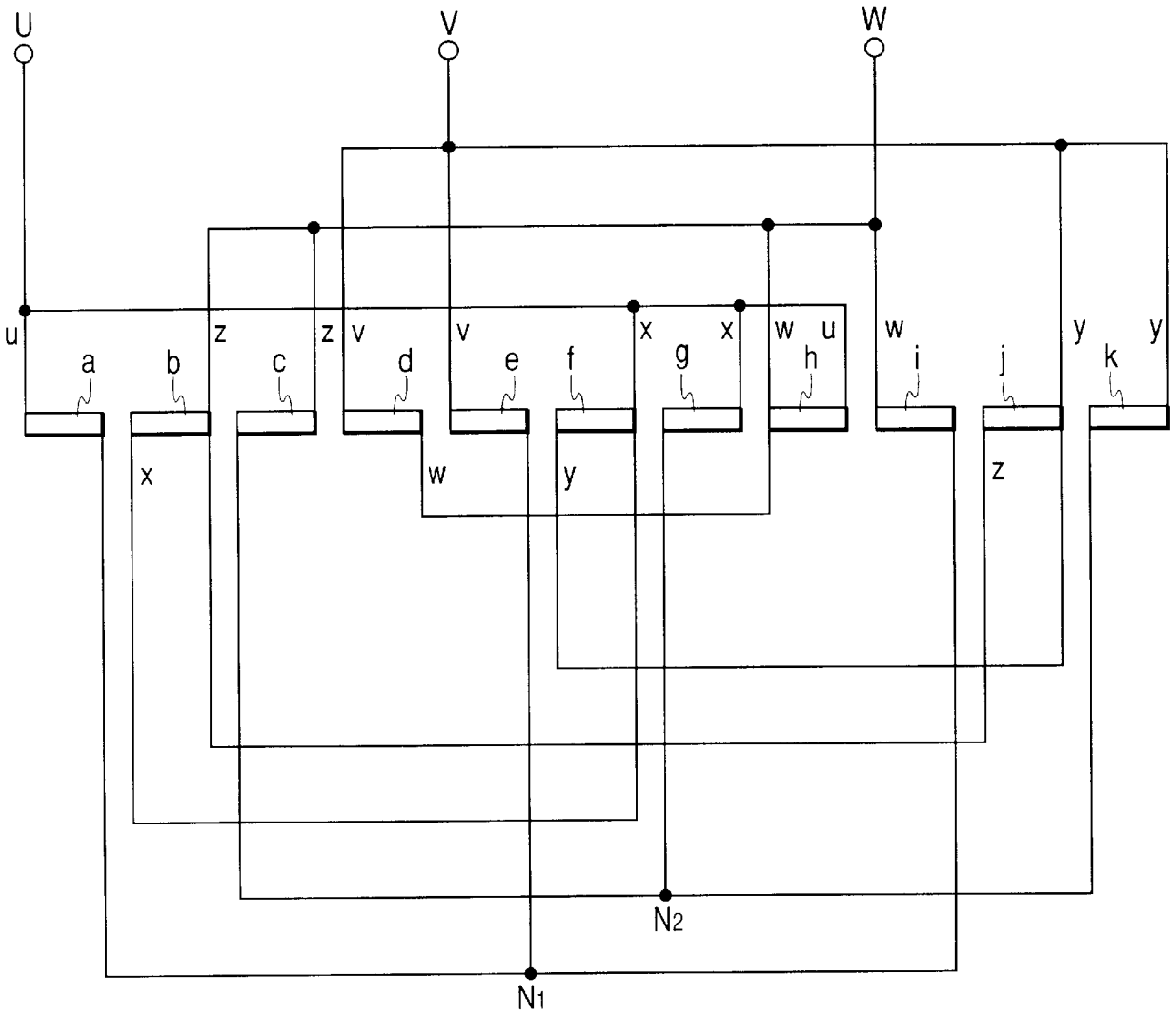
FIG. 25 is a wiring diagram showing the induction coils in the FIG. 24, which are arranged in the phase rotation direction.

FIG. 24 is a wiring diagram showing an eighth embodiment of the present invention. FIG. 25 is a wiring diagram showing the induction coils in the FIG. 24, which are arranged in the phase rotation direction. An induction-heated roller device shown in FIGS. 24 and 25 will be described. In the embodiment, one induction coil, i.e., the induction coil m, delta connected to the three-phase power source in the wiring diagram of FIG. 1 is omitted. Accordingly, a total number of induction coils forming the induction-heated roller device is 11.

As in the embodiment of FIGS. 13 through 23, a phase difference between the voltages applied to the adjacent induction coils is 30°, although a vector diagram is omitted in the FIG. 24 embodiment. In the wiring diagram of FIG. 25, a phase difference between the voltages applied to the adjacently disposed induction coils (a, b), (b, c), (c, d), (d, e), (e, f), (f, g), (g, h), (h, i), (i, j), and (j, k) is 30°. Thus, also in the induction-heated roller device using eleven induction coils, a phase difference between the voltages applied to the adjacent induction coils is 30°. The roll surface temperature distribution is made uniform, and the manufacturing is easy and the cost is reduced.

In the embodiments of FIGS. 13 to 25, "a given number of induction coils are removed from the twelve induction coils shown in FIG. 1". "Removal of the induction coils" means "5 to 11 induction coils are selectively disposed at the positions where the twelve induction coils are to be disposed as shown in FIG. 1., and it does not mean "the twelve induction coils are disposed, and then a given number of induction coils are removed." Accordingly, the present invention holds for a case where 5 to 11 induction coils are selectively disposed at the positions where the twelve induction coils are to be disposed as shown in FIG. 1., and those are wired so that a phase difference between the voltages applied to the adjacent induction coils is 30°.

The present invention holds for a case where the number of induction coils is increased from the twelve induction coils disposed and wired as shown in FIG. 1 or decreased up to five as the lower limit number. In this case, the ampere turn values of the induction coils per unit length of the roll surface are set to be equal so that the inductively heated rolls have an equal temperature. In other words, the number of turns, coil width, resistance values and the like are selected so that the induction coils have an equal ampere turn value. Thus, as the induction coils have an equal ampere turn value, the surface temperature of the roll is made uniform, and the power factor is improved.

As seen from the foregoing description, in the present invention, when a plurality of induction coils serially arrayed within the roll are excited by the utilization of the three-phase power source, a phase difference between the voltages applied to the adjacent induction coils may be set at 30° by merely taking the wiring and the arrangement of twelve induction coils into consideration. The roll surface temperature may be made uniform not using the multiphase transformer, which is essential to the convention technique.

When more than thirteen induction coils are used, the induction-heated roller device is provided which is well fit to the roll length and the heat distribution characteristic of the roll surface heated. Since a phase difference between the voltages applied to the adjacent induction coils may be set at 30°, the roll surface temperature may be made uniform.

Also when five to eleven induction coils are used, a phase difference between the voltages applied to the adjacent induction coils may be set at 30°. Accordingly, the roll surface temperature may be made uniform. Further, since the number of induction coils is reduced, the manufacturing of the induction-heated roller device is easy and the cost to manufacture is reduced.

What is claimed is:

1. An induction-heated roller device comprising:

a rotary roll;

twelve induction coils being successively disposed within a hollow space of said rotary roll while being spaced apart in an axial direction of said rotary roll; and a three-phase power source for exciting said induction coils, wherein said induction coils are arranged into: a first group of three delta connected induction coils excited by line voltages of the three-phase power source; a second group of three star-connected induction coils being excited by said line voltages and being spaced apart in a phase rotation direction of said first group of induction coils; a third group of three delta-connected induction coils being excited by phase-shifted voltages formed by phase-shifting voltages of the three-phase power source by 180° and being spaced apart in a phase rotation direction of said second group of induction coils; and a fourth group of three star-connected induction coils being excited by the phase-shifted voltages and being spaced apart in a phase rotation direction of said third group of induction coils.

2. The induction-heated roller device according to claim 1, further comprising:

at least one induction coil connected in parallel with at least one of said twelve induction coils.

3. An induction-heated roller device comprising:

a rotary roll;

at least five induction coils being successively disposed within a hollow space of said rotary roll while being spaced apart in an axial direction of said rotary roll;

a three-phase power source for exciting said induction coils;

a first delta-connection having at least one of said induction coils being excited by line voltages of the three-phase power source;

a first star-connection having at least one of said induction coils being excited by said line voltages and being spaced apart in a phase rotation direction of said induction coil of first delta connection;

a second delta-connection having at least one of said induction coils being excited by phase-shifted voltages formed by phase-shifting voltages of the three-phase power source by 180° and being spaced apart in a phase rotation direction of said induction coil of said first star-connection;

a second star-connection having at least one of said induction coils being excited by the phase-shifted voltages and being spaced apart in a phase rotation direction of said induction coil of said second delta-connection, wherein the at least five induction coils are selectively located at predetermined positions of said first delta-connection, said first star-connection, said second delta-connection and said second star-connection so that a phase difference of the voltages applied to said induction coils is 30°.

* * * * *